United States Patent [19]

Payne

[11] 4,057,169

[45] Nov. 8, 1977

[54] DUAL TONGUE AND SLOT CONTAINER LOCK

[75] Inventor: Joe R. Payne, La Habra, Calif.

[73] Assignee: Keyes Fibre Company, Waterville, Maine

[21] Appl. No.: 769,567

[22] Filed: Feb. 17, 1977

[51] Int. Cl.[2] ..... B65D 41/18; A47J 41/00; B65D 1/00

[52] U.S. Cl. ..... 220/306; 220/3.1; 229/2.5 R

[58] Field of Search ..... 220/306, 315, 339, 3.1, 220/507; 229/2.5, 43

[56] References Cited

U.S. PATENT DOCUMENTS 3,145,896 8/1964 Reifers et al. ..... 229/2.5

3,935,962 2/1976 Schubert et al. ..... 220/306

3,984,027 10/1976 Smith ..... 220/306

*Primary Examiner*—William Price

*Assistant Examiner*—Steven M. Pollard

*Attorney, Agent, or Firm*—Connolly and Hutz

[57] ABSTRACT

A one-use-disposable type of foamed plastic container including a dished bottom and a dished top hinged to each other, the top having an inwardly flexible front wall the closeable edge of which includes a laterally outwardly directed locking tongue bifurcated by a deep notch into two protruding tongue sections, and the bottom having a skirt with an inwardly directed recess and a pair of slots in the recess to receive the dual tongue sections and lock the bottom and top together in the closed position.

10 Claims, 7 Drawing Figures

DUAL TONGUE AND SLOT CONTAINER LOCK

BACKGROUND OF THE INVENTION

This invention relates to the field of disposable containers for use in the retail packaging of products such as fast food items in the nature of sandwiches and the like, and more particularly to an arrangement for locking together the top and bottom portions of such a container in a manner which prevents inadvertant unlocking yet permits proper locking and unlocking rapidly and easily with one hand.

Prior to the present invention, a wide variety of such containers have been proposed, and many have met with a large measure of commercial success. One troublesome feature, however, connected with the design, manufacture, shipping and use of such containers is the provision of a suitable locking mechanism.

One type of locking device for such containers, the straight tongue-in-slot type, is disclosed in Jewell, U.S. Pat. No. 3,968,921 issued July 13, 1976. One problem with this type of lock is that the narrow tongue extending laterally outwardly from the edge of the container creates a troublesomely weak male locking element, although the slot locking element has the requisite strength.

Another type of locking device for such containers, the flange-in-slotted recess type, is disclosed in Haase, U.S. Pat. No. 3,876,130 issued Apr. 8, 1975. One problem with this type of lock is that the slot formed all the way across the flute or recess in the skirt creates a troublesome weak female locking element, although the elongated flange locking element has the requisite strength.

Thus, the problem heretofore unresolved by the prior art is the provision of a lock which has a male locking element stronger than a narrow outwardly directed tongue, and a female locking element stronger than that provided by a slot clear across a recess in a skirt.

SUMMARY OF THE INVENTION

This invention solves the foregoing problems and provides the heretofore irreconcilable combination of a male locking element which has the requisite strength by means of a dual tongue arrangement provided by a deep central notch, and a female locking element which includes an interconnecting web to correct the weakness otherwise inherent in an elongated slot across a recess.

BRIEF DESCRIPTION OF THE DRAWINGS

Numerous advantages of the present invention will become apparent to one skilled in the art from a reading of the detailed description in conjunction with the accompanying drawings, wherein similar reference characters refer to similar parts, and in which.

DETAILED DESCRIPTION

Figure 1:
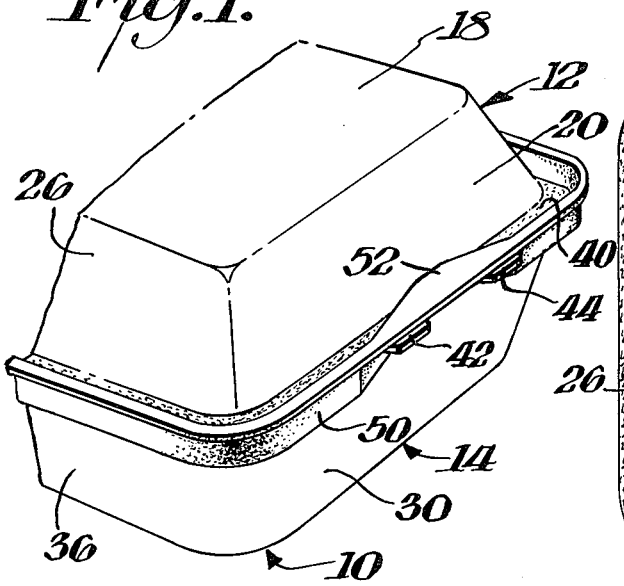
FIG. 1 is a perspective view, partly broken away to conserve space, showing a container according to this invention with the mating top and bottom portions in the closed position.
Figure 3:
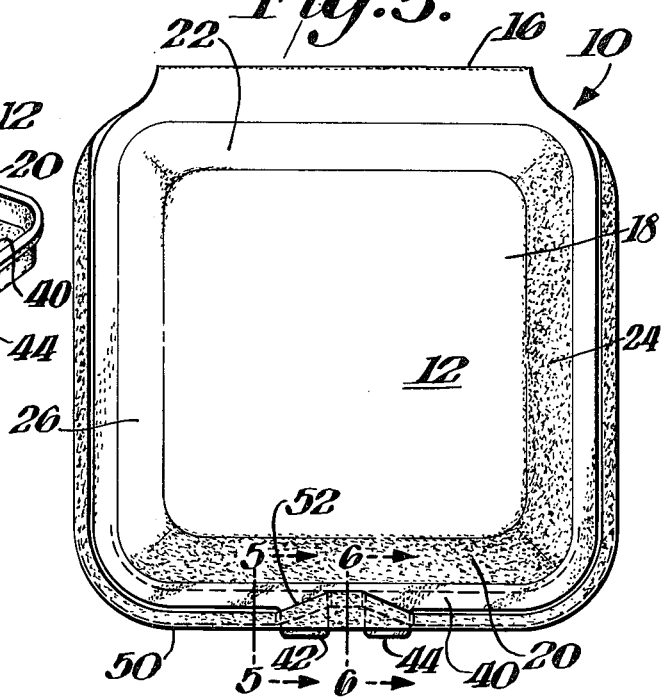
FIG. 3 is a top plan view of the same container.
Figure 6:
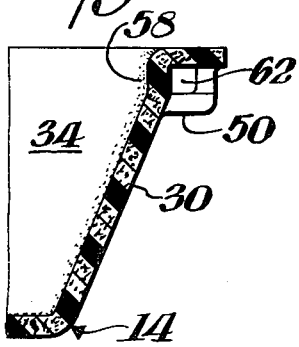
FIG. 6 is an enlarged fragmentary sectional elevational view on line 6—6 of FIG. 3 of the bottom portion only of the container; and, FIG. 7 is an enlarged fragmentary sectional view on line 7—7 of FIG. 2 but showing the dual tongue locking mechanism in plan view flexed inwardly of the dual slot locking mechanism.
Figure 5:
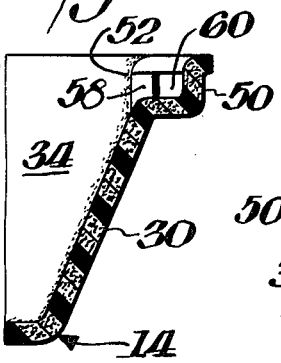
FIG. 5 is an enlarged fragmentary sectional elevational view on line 5—5 of FIG. 3 of the bottom portion only of the container.
Figure 2:
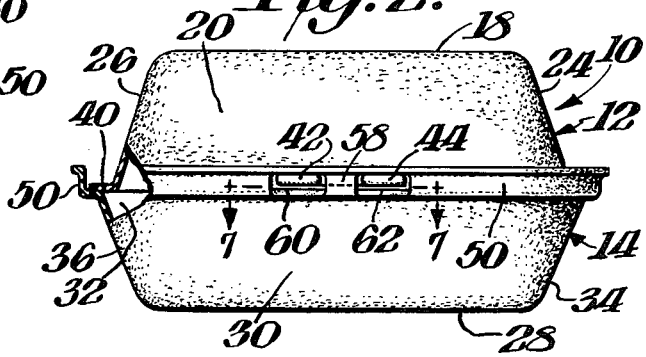
FIG. 2 is a front elevational view of the container of FIG. 1.

The presently preferred embodiment of the lock according to the present invention is illustrated in the drawings on a "square" disposable plastic container consisting of a top and bottom hinged together for packaging a product such as a hamburger sandwich or the like. This particular container is merely illustrative, however, of the many types of containers on which the lock according to this invention is believed to be useful. For instance, the container shown in the drawings has the top hinged to the bottom, but the lock according to this invention is useful on other types of containers where the top is separate and removable from the bottom, in which case two such locks would be provided, one on each side of the container. The container shown in the drawings is generally rectangular in plan view, namely square with rounded corners, but other shapes such as elongated rectangles, oblongs, circles, and other well known container shapes will also benefit from the lock according to this invention. The container shown in the drawings also includes a relatively deeply dished top and a relatively deeply dished bottom, but other shapes including a relatively flat bottom or a relatively flat top will also find utility with the lock according to this invention. The container shown in the drawings is molded of inexpensive substantially uniform thickness material such as foamed plastic, but other materials such as molded pulp may be used to make containers which will benefit from the lock according to this invention. Finally, the container shown in the drawings is of the one-use-disposable variety for packaging a fast food product, but reuseable containers having a wide variety of other packaging uses will benefit, it is now believed, from the lock according to this invention.

The illustrated container 10 includes two mating portions such as a top 12 and a bottom 14 which are capable of packaging a product such as a hamburger sandwich therebetween in the closed position. The top 12 and bottom 14 are hingedly connected as at 16 to each other so that they may be rotated about the hinge into and out of the closed position. The top 12 is dish shaped with a base or upper wall 18 and outwardly flared surrounding side walls including a front side wall 20, a rear side wall 22, and opposed end side walls 24, 26. The bottom 14 is also dish shaped with a base or lower wall 28 and outwardly flared surrounding side walls including a front side wall 30, a rear side wall 32, and opposed end side walls 34, 36. The base walls are illustrated as generally planar, but they may include inwardly depressed ribs for strengthening, compartmenting, or other purposes.

The front side wall 20 of the top 12 is inwardly flexible in response to light manual pressure, after a fashion which is known and for the purpose of locking and unlocking the container as will become apparent below. The inward flexibility of the front side wall 20 may be achieved partly by the yieldable nature of the plastic or other resilient material of which the container is made, and partly by the shiftable nature of the hinged connection 16 which permits slight rearward movement of the top 12 with respect to the bottom 14 of the container 10.

The lower or closeable edge of the front side wall 20 of the container is defined by a laterally outwardly directed planar flange 40, which also may extend around the corners of the top 12 and define all or a portion of the lower closeable edge of the end side walls 24 and 26.

A laterally outwardly directed locking tongue protrudes from the flange 40 of the closeable edge of the flexible side wall 20. The locking tongue is bifurcated into two protruding sections 42 and 44 by a notch 46. As most clearly seen in the upper portion of FIG. 7, the tongue sections 42 and 44 are outward extensions of the flange 40, and are in the same plane as the flange but extend outwardly beyond its outer margin. The notch 46 is deeper and extends inwardly past the outer margin of the flange 40. This arrangement strengthens the locking tongue by lengthening the potential bend or break line of each tongue section and angling it to the usual direction of bending or breaking.

The bottom 14 of the container 10 has a skirt 50 along the upper or closeable edge of the front side wall 30. If desired, the skirt 50 may extend around the corners and along part or all of the length of the closeable upper edges of the end side walls 34 and 36. The skirt 50 overlies the lower closeable edge of the flexible wall 20 of the top 12 in the closed position. In this fashion, the skirt 50 forms a shoulder which supports the flange 40 of the top 12 against excessive closing motion, and orients the top 12 and bottom 14 into proper closed position registry.

The skirt 50 further includes an inwardly directed recess 52 located in opposition to the locking tongue of the front wall 20 of the top 12. The recess 52 is formed by a first inwardly angled wall 54 and a second inwardly angled wall 56 which are connected at their outer ends to the skirt 50 and at their inner ends to a rear wall 58. The rear wall 58 constitutes a web which provides a vertical interconnection between the main portion of the front side wall 30 and the top lip of the recess 52. The recess also includes a pair of slots 60 and 62, located in the inwardly angled walls 54 and 56, respectively, of the recess 52. The slots 60 and 62 are thus separated from each other by the interconnecting web or rear wall 58 of the recess, as can be clearly seen from the lower portion of FIG. 7.

Figure 7:
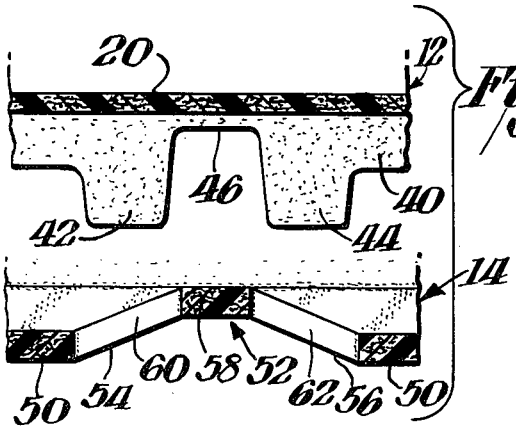
Figure 4:
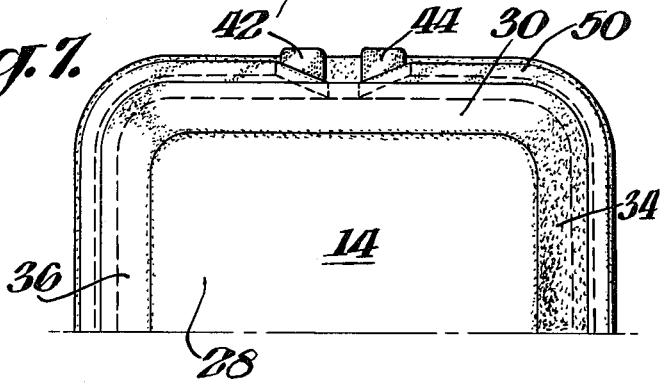
FIG. 4 is a partial bottom plan view of the container.

As can also be seen in FIG. 7, the width of the notch 46 at its base or deepest portion is only slightly greater than the width of the web 58, and the width of the slots 60, 62 is only sligthly greater than the width of the tongue sections 42, 44. These dimensions permit each dual or bifurcated section 42, 44 of the tongue to be inserted in one of the slots 60, 62 in the recess 52, and the notch 46 to accommodate the web 58 of the recess 52, to lock the top 12 and bottom 14 of the container 10 together in the closed position.

The top and bottom of the container may be unlocked from each other by flexing the front side wall 20 of the top 12 inwardly or rearwardly to withdraw the forked tongue sections 40, 42 from the dual slots 60, 62 in the recess 52 of the bottom 14 to permit the container 10 to be opened.

The above described container may of course be used in the inverted position, in which case the top becomes the bottom and the bottom becomes the top.

While the above described embodiment constitutes the presently preferred mode of practicing this invention, other embodiments and equivalents are within the scope of the actual invention. I claim:

1. A container including two mating portions capable of packaging a product therebetween in the closed position, one of the portions having an inwardly flexible side wall with a laterally outwardly directed locking tongue protruding from its closeable edge, the other portion having a skirt along its corresponding closeable edge which overlies the closeable edge of the one portion in the closed position, an inwardly directed recess in the skirt located in opposition to the locking tongue, the improvement comprising a pair of slots in the recess separated from each other by an interconnecting web and a notch bifurcating the locking tongue into two protruding sections whereby each bifurcated section of the tongue is inserted in one of the slots in the recess and the notch accommodates the web of the recess to lock the two portions together in the closed position, and the two portions of the container may be unlocked by flexing the side wall of the one portion inwardly to withdraw the tongue sections from the slots in the recess of the other portion to permit the container to be opened.

2. A container as in claim 1 wherein the closeable edge of the inwardly flexible side wall of the one portion is defined by a laterally outwardly directed planar flange having an outer margin, the tongue sections are outward extensions of the flange in the same plane as the flange, and the notch bifurcating the tongue sections extends inwardly past the outer margin of the flange.

3. A container as in claim 1 wherein the inwardly directed recess in the skirt is formed by a pair of inwardly angled walls connected at their outer ends to the skirt and at their inner ends to a rear wall, the slots being located in the inwardly angled walls and the rear wall constituting the web.

4. A container as in claim 1 wherein the width of the notch at its base is only slightly greater than the width of the web which it accommodates in the closed position.

5. A container as in claim 1 wherein the effective width of the slots is only slightly greater than the width of the tongue sections inserted in them in the closed position.

6. A container as in claim 1 wherein the two mating portions are hingedly connected to each other so that the two portions may be rotated about the hinge into and out of the closed position.

7. A container as in claim 1 wherein each of the two mating portions is generally rectangular, and the skirt extends along one side and part of each adjacent side of the other portion, and in the closed position overlies the corresponding edge of the one portion and part of the edges of each adjacent side of the one portion.

8. A container as in claim 1 wherein each of the two mating portions are dish shaped with a base wall and surrounding side walls, the closeable edges of which are in mating engagement in the closed position.

9. A container as in claim 1 wherein the two mating portions are molded of inexpensive substantially uniform thickness material to form a container of the one-use-disposable variety for packaging a food product, each of the two mating portions are dish shaped with a base wall and surrounding side walls, the closeable edges of which are in mating engagement in the closed position, the one portion having the inwardly flexible side wall forms the top of the container and the other portion having the skirt forms the bottom of the container, the top and bottom are hingedly connected to each other so that they may be rotated about the hinge into and out of the closed position, the closeable edge of the inwardly flexible side wall of the top is defined by a laterally outwardly directed planar flange and the tongue sections are outward extensions of the flange, and the skirt of the bottom forms a shoulder which supports the flange of the top in the closed position.

10. A container as in claim 9 wherein the inexpensive substantially uniform thickness material is foamed plastic.

* * * * *

Notice of Adverse Decision in Interference

In Intereference No. 100,271, involving Patent No. 4,057,169, J. R. Payne, DUAL TONGUE AND SLOT CONTAINER LOCK, final judgment adverse to the patentee was rendered Apr. 10, 1980, as to claims 1, 3–10.

[*Official Gazette July 22, 1980.*]